US009208740B2

(12) United States Patent
Wu

(10) Patent No.: US 9,208,740 B2
(45) Date of Patent: Dec. 8, 2015

(54) GATE DRIVER AND DISPLAY DEVICE USING THE SAME

(75) Inventor: Tse-Hung Wu, New Taipei (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 350 days.

(21) Appl. No.: 13/166,791

(22) Filed: Jun. 22, 2011

(65) Prior Publication Data

US 2012/0194497 A1 Aug. 2, 2012

(30) Foreign Application Priority Data

Jan. 27, 2011 (TW) ..... 100103028 A

(51) Int. Cl.
*G09G 5/00* (2006.01)
*G09G 3/36* (2006.01)

(52) U.S. Cl.
CPC ..... *G09G 3/3677* (2013.01); *G09G 2310/0291* (2013.01); *G09G 2320/0223* (2013.01)

(58) Field of Classification Search
CPC ..... G09G 3/3677; G09G 2310/0291; G09G 2320/0223
USPC ..... 345/98–100
See application file for complete search history.

(56) References Cited

U.S. PATENT DOCUMENTS

| | | | | |
|---|---|---|---|---|
| 7,304,622 | B2 * | 12/2007 | Kobayashi et al. | 345/87 |
| 8,519,934 | B2 * | 8/2013 | Huang et al. | 345/100 |
| 2006/0001640 | A1 | 1/2006 | Lee | |
| 2009/0079715 | A1 | 3/2009 | Kim | |
| 2010/0109995 | A1 * | 5/2010 | Fang | 345/100 |
| 2011/0102406 | A1 * | 5/2011 | Wang et al. | 345/211 |

FOREIGN PATENT DOCUMENTS

| | | |
|---|---|---|
| TW | 200516528 | 5/2005 |
| TW | 200614136 | 5/2006 |
| TW | 201019301 | 5/2010 |

* cited by examiner

*Primary Examiner* — Kumar Patel
*Assistant Examiner* — Afroza Chowdhury
(74) *Attorney, Agent, or Firm* — Winston Hsu; Scott Margo

(57) ABSTRACT

A gate driver includes a logic circuit for generating a plurality of buffer input signals and a modulation signal, a plurality of buffers each for generating a respective gate driving signal according to a corresponding one of the plurality of buffer input signals, and a switch module for controlling electrical connection between a first voltage source and the plurality of buffers. During a modulation period, the modulation signal indicates the switch module to break the electrical connection, and the plurality of buffer input signals are configured to short output terminals of the plurality of buffers so as to modulate the gate driving signals.

23 Claims, 8 Drawing Sheets

GATE DRIVER AND DISPLAY DEVICE USING THE SAME

BACKGROUND OF THE INVENTION

1. Field of the Invention

The present invention is related to a gate driver and display device using the same, and more particularly, to a gate driver capable of modulating gate driving signals through charge sharing, and display device using the same.

2. Description of the Prior Art

A liquid crystal display (LCD) display has characteristics of light weight, low power consumption, zero radiation, etc. and is widely used in many information technology (IT) products, such as computer systems, mobile phones, and personal digital assistants (PDAs). The operating principle of the LCD display is based on the fact that different twist states of liquid crystals result in different polarization and refraction effects on light passing through the liquid crystals. Thus, the liquid crystals can be used to control amount of light emitted from the LCD display by arranging the liquid crystals indifferent twist states, so as to produce light outputs at various brightnesses, and diverse gray levels of red, green and blue light.

Please refer to FIG. 1, which is a schematic diagram of a thin film transistor (TFT) LCD display 10 of the prior art. The LCD display 10 includes an LCD panel 100, a source driver 102, a gate driver 104 and a voltage generator 106. The LCD panel 100 is composed of two substrates, and space between the substrates is filled with liquid crystal materials. One of the substrates is installed with data lines 108, scan lines (or gate lines) 110 and TFTs 112, and the other substrate is installed with a common electrode to provide a common signal Vcom outputted by the voltage generator 106. The TFTs 112 are arranged as a matrix on the LCD panel 100. Accordingly, each data line 108 corresponds to a column of the LCD panel 100, each scan line 100 corresponds to a row of the LCD panel 100, and each TFT 112 corresponds to a pixel. Note that, the LCD panel 100 composed of the two substrates can be regarded as an equivalent capacitor 114.

In FIG. 1, the gate driver 104 sequentially generates the gate driving signals VG_1-VG_M to row by row activate the TFTs 112 and update pixel data stored in the equivalent capacitors 114. In detail, please refer to FIG. 2, which is a schematic diagram of the gate driver 104. The gate driver 104 includes a logic circuit 105 and buffers 107_1-107_M. Load modules 109_1-109_M are equivalent circuits of loads. The logic circuit 105 controls transistor switches of the buffers 107_1-107_M to alternatively provide a high voltage VGG or a low voltage VEE to the load modules 109_1-109_M, so as to create square waves of the gate driving signals VG_1-VG_M.

However, since parasitic capacitors exist between the equivalent capacitors 114 and gates of the TFTs 112, variations of the gate driving signals VG_1-VG_M couple into the equivalent capacitors 114 via the parasitic capacitors at falling edges of the square waves of the gate driving signals VG_1-VG_M, resulting in distortion of image contents stored in the equivalent capacitors 114.

Therefore, finding an economic and power-efficient solution to alleviate the falling-edge coupling effect of the gate driving signals and overcome the image content bias problem has been a major focus of the industry.

SUMMARY OF THE INVENTION

It is therefore a primary objective of the claimed invention to provide a gate driver capable of moderating falling edges of gate driving signals without employing extra complex control circuits, thus mitigating falling-edge coupling effect of gate driving signals and image distortion. Moreover, a display device using said gate driver is also provided.

An embodiment discloses an a gate driver, including a logic circuit, for generating a plurality of buffer input signals and a modulation signal; a plurality of buffers, each for generating a gate driving signal according to one of the plurality of buffer input signals, wherein each of the buffers is coupled between a first voltage source node and a second voltage source; and a switch module, coupled between the first voltage source node and a first voltage source, for determining whether the first voltage source is electrically connected to the first voltage source node according to the modulation signal; wherein during a modulation period, the modulation signal causes the switch module to be cut-off, and the plurality of buffer input signals are configured to short all or some of a plurality of output terminals, so as to modulate the gate driving signals.

Another embodiment discloses a display device, including the above-mentioned gate driver, and a panel, for displaying an image according to the gate driver These and other objectives of the present invention will no doubt become obvious to those of ordinary skill in the art after reading the following detailed description of the preferred embodiment that is illustrated in the various figures and drawings.

DETAILED DESCRIPTION

Figure 4:
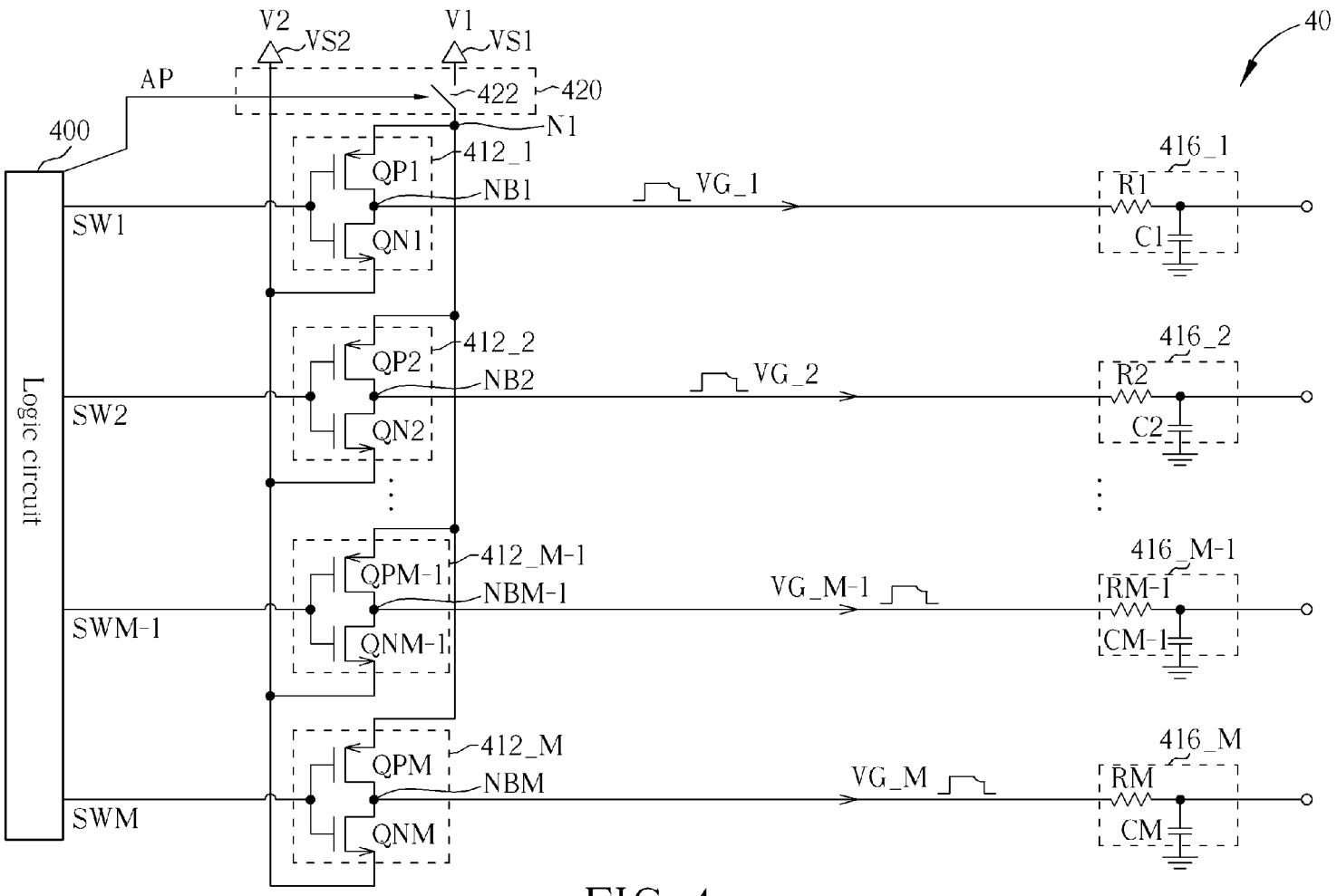
FIG. 4 is a schematic diagram of a gate driver according to an embodiment.

Please refer to FIG. 4, which is a schematic diagram of a gate driver 40 according to an embodiment. The gate driver 40 can be applied in a display device (e.g. a Liquid Crystal Display, LCD), to control a pixel updating timing of the display device for image display. The gate driver 40 includes a logic circuit 400, buffers 412_1-412_M and a switch module 420. The logic circuit 400 is utilized for generating buffer input signals SW1-SWM and a modulation signal AP. Each of the buffers 412_1-412_M is coupled between a first voltage source node N1 and a second voltage source VS2 (for providing a second voltage V2). The buffers 412_1-412_M respectively output gate driving signals VG_1-VG_M via output terminals NB1-NBM to load modules 416_1-416_M according to the corresponding buffer input signals SW1-SWM. The switch module 420 is coupled between the first voltage source node N1 and a first voltage source VS1 (for providing a first voltage V1), to determine whether the first voltage source VS1 is electrically connected to the first voltage source node N1 according to the modulation signal AP, i.e. to control a power supply path from the first voltage source VS1 to the buffers 412_1-412_M.

Under appropriate control of the logic circuit 400, each of the gate driving signals VG_1-VG_M outputted by the buffers 412_1-412_M can be alternately switched between a first driving level and a second driving level which respectively correspond to conduction and cut-off levels of TFT of the display panel. In this embodiment, preferably, the first and second driving levels are exemplarily illustrated to be respectively equal to the first voltage V1 and the second voltage V2. In practice, the first and second driving levels may be similar to, or different from the first and the second voltages V1, V2.

Figure 1:
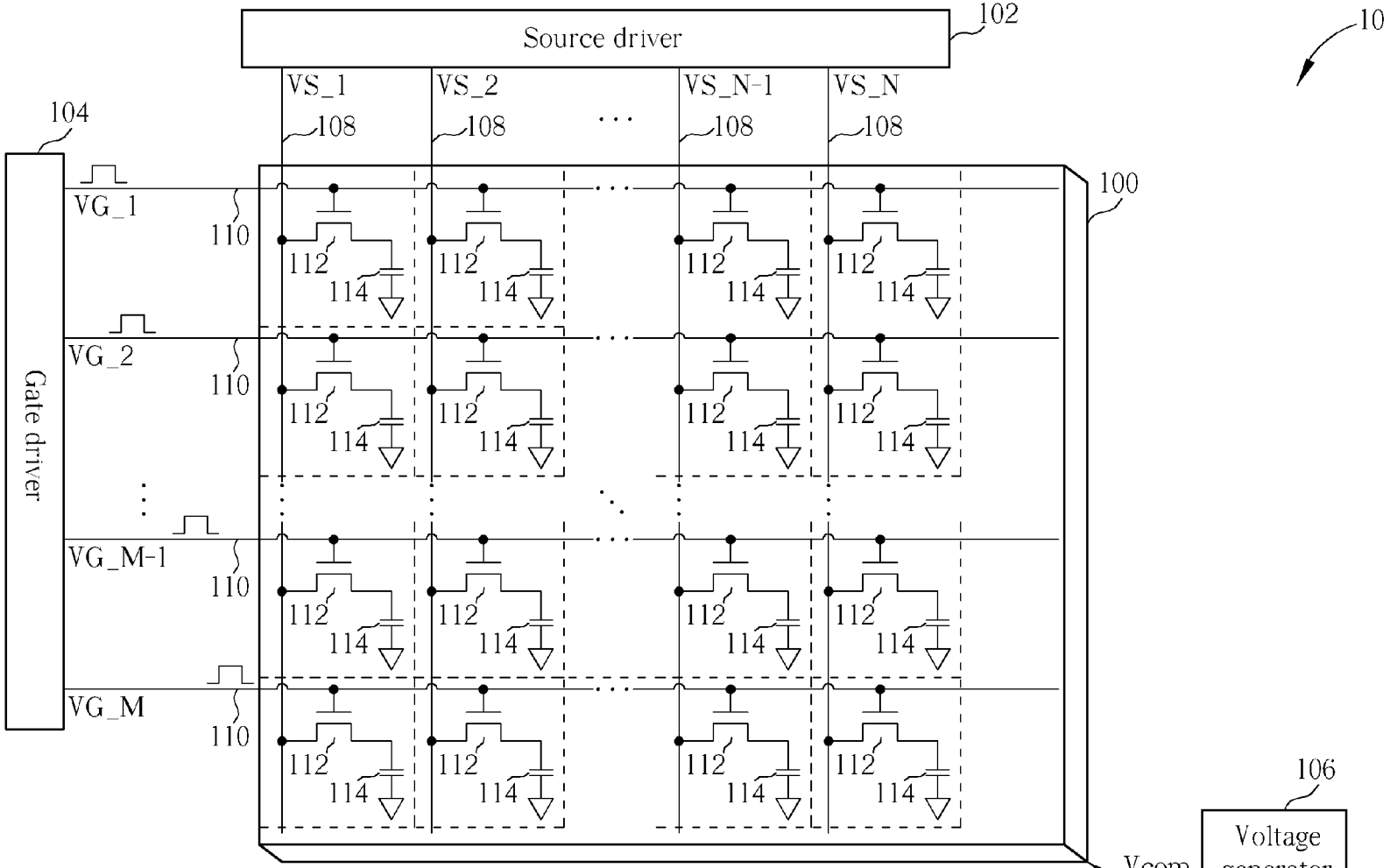
FIG. 1 PRIOR ART
FIG. 1 is a schematic diagram of a TFT LCD monitor of the prior art.
Figure 2:
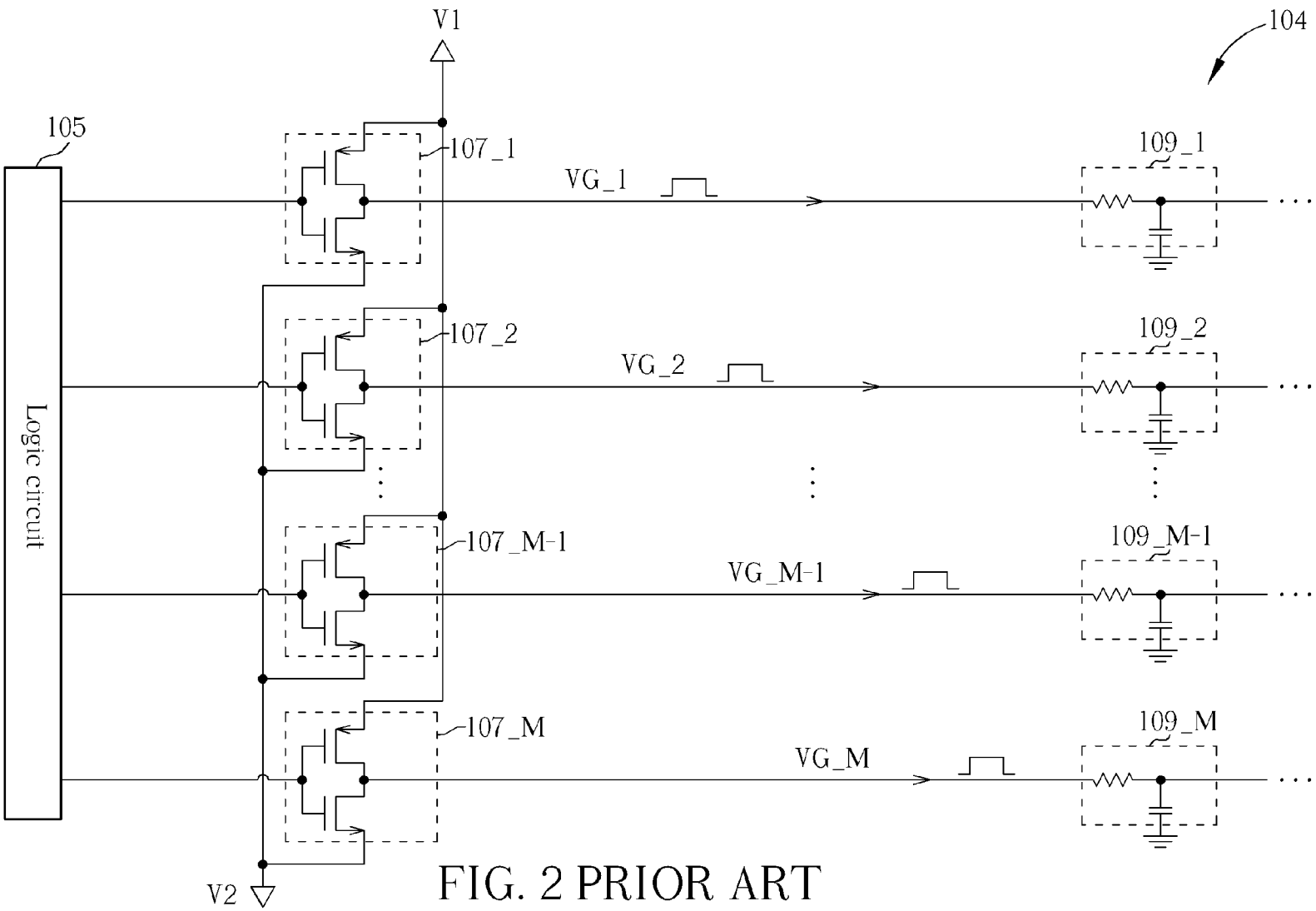
FIG. 2 PRIOR ART
FIG. 2 is a schematic diagram of a gate driver of the TFT LCD monitor shown in FIG. 1.
Figure 3:
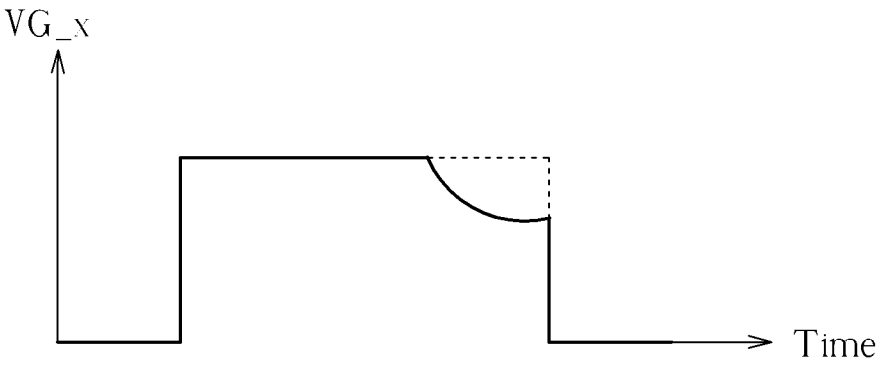
FIG. 3 is a timing diagram of a gate driving signal after modulation.

To mitigate image distortion and the falling-edge coupling effect of the gate driving signals, the logic circuit 400 may modulate the gate driving signals VG_1-VG_M. Through the modulation, it is possible to adjust waveforms of square waves of the gate driving signals VG_1-VG_M, as shown in FIG. 3. In FIG. 3, edges of the square waves of the gate driving signals VG_1-VG_M are modulated to have rounded concave edges for example, thereby preventing abrupt variations of the gate driving signals VG_1-VG_M from affecting the stored pixel data.

To implement the above-mentioned modulation, during a modulation period, the modulation signal AP is configured to disable the switch module 420, and the buffer input signals SW1-SWM are configured to mutually short the output terminals NB1-NBM. Such operations in turn cause the load modules 416_1-416_M to share the stored charges, and therefore modulating the gate driving signals VG_1-VG_M. The modulation reshapes the waveforms of the gate driving signals VG_1-VG_M, e.g. adjusting at least one of a voltage level and a voltage slope, thereby reducing an impact that the coupling effect has on grayscale values of stored pixels.

In a preferable embodiment, the modulation period may be arranged at end portions of the square waves of one or more of the gate driving signals VG_1-VG_M, e.g. when the one or more of the gate driving signals are switched from the first driving level (i.e. first voltage V1 in this embodiment) to the second driving level (i.e. the second voltage V2 in this embodiment). During the modulation period, the modulation signal AP generated by the logic circuit 400 is configured to disable the switch module 420, such that the first voltage V1 cannot be provided to the buffers 412_1-412_M. Moreover, when the switch module 420 is disabled, the buffer input signals SW1-SWM generated by the logic circuit 400 are also configured to mutually short the output terminals NB1-NBM of the buffers 412_1-412_M. As a result, the charges stored in the load modules 416_1-416_M can be shared among the load modules, in turn allowing levels of the one or more of the gate driving signals VG_1-VG_M to start switching toward the level of the second voltage V2 in advance, before actually reaching the second voltage V2. Note that, multiple outputs may also be simultaneously modulated according to the above-mentioned method, since some of the gate driving signals VG_1-VG_M may be simultaneously switched from the first voltage V1 to the second voltage V2.

FIG. 4 is a schematic diagram of detailed structures of a gate driver 40 according to an embodiment, which illustrates detailed structures of the buffers 412_1-412_M, the load modules 416_1-416_M and the switch module 420. In this embodiment, each of the buffers 412_1-412_M includes a voltage pull-up block and a voltage pull-down block, coupled in serial between the first voltage source node N1 and the second voltage source VS2, and respectively outputs the first driving level (e.g. the first voltage V1) and the second driving level (e.g. the second voltage V2) when enabled. For example, the voltage pull-up blocks may be respectively implemented by P-type field effect transistors (FET) QP1-QPM, and the voltage pull-down blocks can be respectively implemented by N-type FETs QN1-QNM. Gates of the transistors QPx and QNx (wherein x=1−M) are coupled together to be the buffer input terminal NBx of the buffer 412_x. Therefore, the buffers 412_1-412_M may output the first voltage V1 or the second voltage V2 as the gate driving signals VG_1-VG_M according to the levels of the corresponding buffer input signals SW_1-SW_M. Furthermore, the load modules 416_1-416_M include load resistors R1-RM and load capacitors C1-CM utilized for storing or outputting charges in response to the gate driving signals VG_1-VG_M outputted by the buffers 412_1-412_M. Furthermore, the switch module 420 includes a switch 422 coupled between the first voltage source VS1 and the first voltage source node N1 and utilized for determining whether the first voltage source VS1 is electrically connected to the first voltage source node N1 according to the modulation signal AP.

During a modulation period, e.g. during end portions of square waves of one or more of the plurality of gate driving signals VG_1-VG_M, the switch 422 may cut off the power supply path from the first voltage source VS1 to the buffers 412_1-412_M. Concurrently, levels of the buffer input signals SW_1-SW_M are configured to enable all of the P-type FETs QP1-QPM, causing all of the output terminals NB1-NBM to short. As a result, the load capacitors C1-CM may share the stored charges, thereby varying the square wave waveforms of the gate driving signals VG_1-VG_M.

Note that, the structure shown in FIG. 4 merely serves illustrative purposes. Any other circuit structures capable of generating output gate driving signals and suitably shorting the output terminals according to the buffer input signals are suitable for the buffers 412_1-412_M. Moreover, any circuit structures capable of controlling the power supply path between the first voltage source VS1 and the buffers 412_1-412_M are applicable for the switch module 420. Moreover, there can also be different equivalent circuits for the load modules 416_1-416_M. Furthermore, The buffers 412_1-412_M are not limited to output only two voltage levels as the gate driving signals VG_1-VG_M and may output more levels, one or more of which can be modulated to have smoother falling edges of square waves.

Note that, the embodiment shown in FIG. 4 features that a first voltage source node N1 between the switch module 420 and the buffers 412_1-412_M is cut-off from external circuits without receiving any additional voltage bias from external power sources, that is, no additional external components are required. Therefore, current loss in external components can be avoided. Moreover, for multiple outputs, this feature allows modulated amplitudes of the gate driving signals VG_1-VG_M to remain nearly uniform. Simply put, this embodiment is capable of economically and power-efficiently modulating the gate driving signals VG_1-VG_M.

Figure 5:
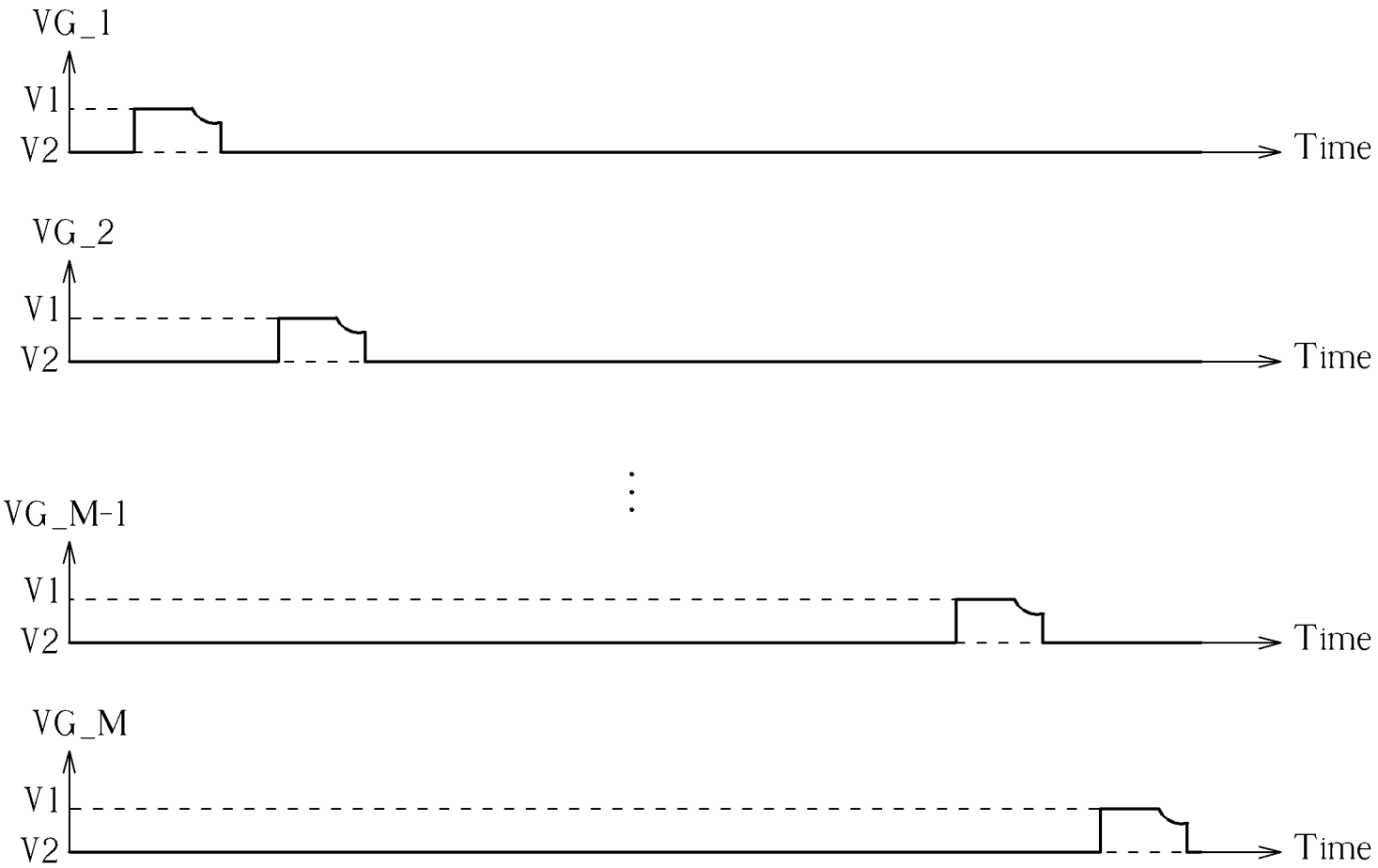
FIG. 5 is a timing diagram of gate driving signals generated by the gate driver shown in FIG. 4, according to an embodiment.

Please continue to refer to FIG. 5, which is a timing diagram of the gate driving signals VG_1-VG_M. Since the gate driving signals VG_1-VG_M sequentially scan the TFT by rows, during each scan period, only a minority (one or more) of the gate driving signals VG_1-VG_M carry square waves. During the modulation period, through charge sharing of the load capacitors C1-CM, square waves of the minority of gate driving signals may gradually decline to a weighted average value of the gate driving signals VG_1-VG_M, i.e.

$$VG_x = \frac{V1 \cdot Ms \cdot C + V2 \cdot (M - Ms) \cdot C}{M \cdot C} \quad \text{(Eq. 1)}$$

Note that, VG_x represents a voltage value of a gate driving signal carrying a square wave after charge sharing, Ms represents a quantity of gate driving signals in the gate driving signals VG_1-VG_M that is currently in the process of a scan operation (carrying a square wave), and C represents the capacitance value of each load module (assuming all of the load capacitors C1-CM have the same capacitance value). Since charge sharing is a gradual process, the gate driving signal VG_x gradually decreases after the modulation starts, achieving waveform reshaping. According to FIG. 5, only one gate driving signal is outputting a square wave at a given time (i.e. Ms=1), and through charge sharing, each of the gate driving signals VG_1-VG_M may be modulated at different times to gradually decline at each of their respective falling edges.

According to Eq. 1, after modulation, the voltage values of the gate driving signals VG_2-VG_M depend on Ms, the quantity of gate driving signals in operation, and M, the quantity of charge sharing gate driving signals. Although the above describes that all of the output terminals NB1-NBM of the buffers 412_1-412_M are mutually shorted to share charges among all of the load modules 416_1-416_M during the modulation period, in practice, it is possible to design the quantity of output terminals that are shorted, i.e. to design a quantity of gate driving signals that need to be modulated to meet different requirements. More specifically, through configuring the buffer input signals SW_1-SW_M, it is possible to have a load module 416_*x* of a certain buffer 412_*x* in operation (outputting the voltage V1) only share charges with load modules 416_(*x*−n1)-416_(*x*+n2) of certain buffers (preferably, nearby adjoining buffers) 412_(*x*−n1)-412_(*x*+n2), wherein n1 and n2 are integers, so as to create different modulated amplitudes. For example, in a case where n1=n2=n, the VG_x value of the gate driving signal after modulation is:

$$VG_x = \frac{V1 \cdot 1 \cdot C + V2 \cdot 2 \cdot n \cdot C}{(2 \cdot n + 1) \cdot C} \quad \text{(Eq. 2)}$$

In summary of the above, since only a small portion of the buffers 412_1-412_M are "in operation" and carry square waves at a given time, it is possible for load modules of the buffers "in operation" to engage in charge sharing with load modules of some or all of the other "idle" buffers, achieving the modulation effect on the gate driving signals VG_1-VG_M.

Figure 6:
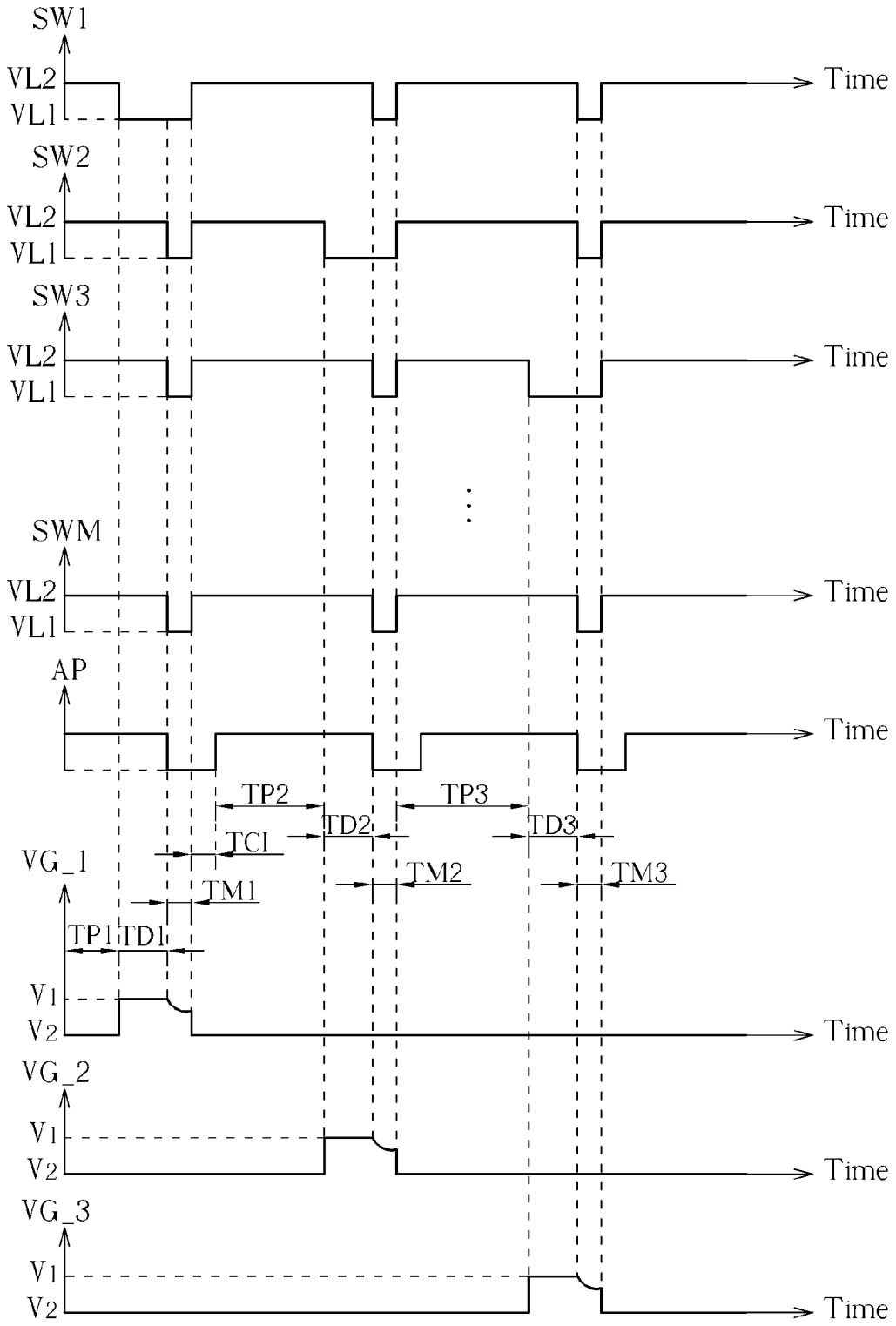
FIG. 6 is a timing diagram of buffer input signals, modulation signal and gate driving signals of the gate driver shown in FIG. 4, according to an embodiment.

Please refer to FIG. 6, which are timing diagrams of the buffer input signals SW_1-SW_M, the modulation signal AP and the gate driving signal VG_1-VG_3 shown in FIG. 4 according to an embodiment. During different scan periods, a different gate driving signal VG_x (x is an integer between 1 and M) alternatively turns into a square wave. This embodiment illustrates an exemplary case where only one gate driving signal outputs a square wave at a given time (i.e. Ms=1). However, this can be easily generalized to other cases with Ms>1. Each scan period can be sectioned into a preparation period, a driving period, a modulation period and a preparation period. The following illustrates with a scan period corresponding to a gate driving signal VG_1.

During a preparation period TP1, the modulation signal AP enables the switch module 420, and the buffer input signals SW_1-SW_M are configured to cause all of the gate driving signals VG_1-VG_M to turn to the second driving level (i.e. the second voltage V2). As for detailed structures of FIG. 4, all of the buffer input signals SW_1-SW_M are configured to be at a second input level VL2, such that the voltage pull-down block is enabled to output the second voltage V2.

Next, during a driving period TD1, the modulation signal AP continues to enable the switch module 420, and the buffer input signals SW_1-SW_M are configured to cause the gate driving signal VG_1 to be at the first driving level (i.e. the first voltage V1), and the gate driving signals VG_2-VG_M to be at the second driving level (i.e. the second voltage V2). To achieve this, the buffer input signal SW_1 corresponding to the gate driving signal VG_1 is configured to be at the first input level VL1 that can enable the voltage pull-up block, such that buffer 412_1 outputs the first voltage V1. Additionally, the buffer input signals SW_2-SW_M corresponding to the remaining gate driving signals VG_2-VG_M are configured to be maintained at the second input level VL2, such that the remaining buffers 412_2-412_M output the first voltage V1.

Subsequently, during a modulation period TM1, the modulation signal AP disables the switch module 420, and the buffer input signals SW_1-SW_M are configured to short the output terminals NB1-NBM, resulting in charge sharing among the load capacitors C1-CM. As such, the gate driving signal VG_1 is varied from the first voltage V1 to the second voltage V2, and the other gate driving signals VG_2-VG_M are varied from the second voltage V2 to the first voltage V1 (not shown, as the variation is relatively subtle). In order to short the buffer input signals SW_1-SW_M, the buffer input signals SW_2-SW_M may be configured to be at the first input level VL1, such that the voltage pull-up blocks of all the buffers are enabled.

Finally, during a transition period TC1, the modulation signal AP continues to disable the switch module 420, and the buffer input signals SW_1-SW_M are configured to cause the gate driving signals VG_1-VG_M to be at the second voltage V2. To achieve this, the buffer input signals SW_2-SW_M may be arranged to recover back to the second input level VL2, such that the second voltage source VS2 supplies power to all of the buffers 412_1-412_M.

Next, in a similar manner, generation of the gate driving signals VG_2-VG_M also sequentially undergoes switching control of the four phases (TP2, TD2, TM2, TC2 . . . ), and are modulated through charge sharing, the details of which are not reiterated here.

Note that, in the embodiment shown in FIG. 6, during each modulation period, only one single buffer is in operation, i.e. only one gate driving signal carries a square wave with a rounded concave corner after modulation. However, this embodiment only serves illustrative purposes. In practice, this may be easily generalized to any quantity of operating buffers to meet different requirements. Moreover, in the embodiment shown in FIG. 6, during each modulation period, all of the output terminals NB1-NBM are configured to be shorted, so as to achieve charge sharing between all of the load modules 416_1-416_M. However, this is only an exemplary implementation, and may be generalized to any quantity of shorted output terminals, according to practical requirements.

Figure 7:
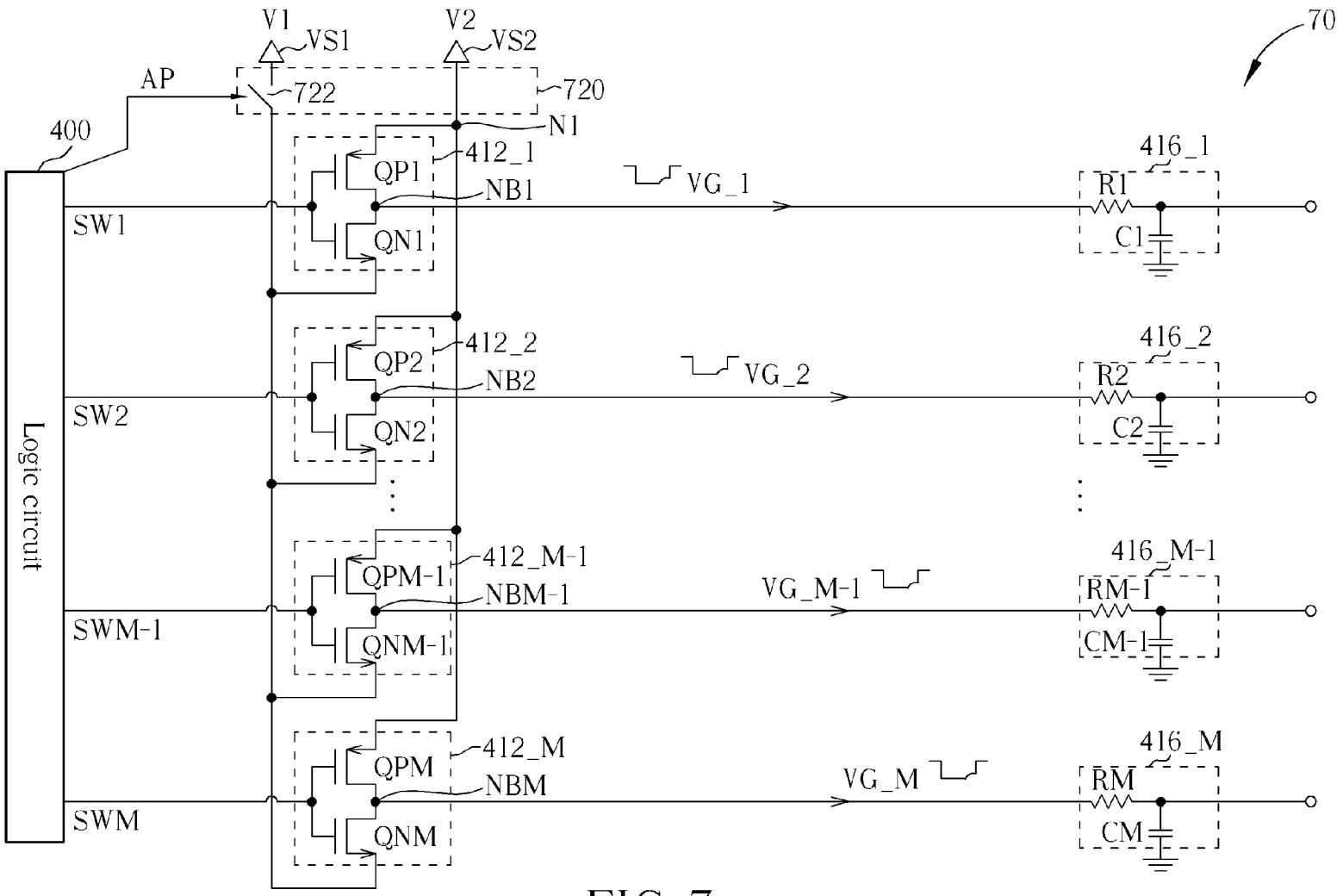
FIG. 7 is a schematic diagram of another gate driver according to an embodiment.
Figure 8:
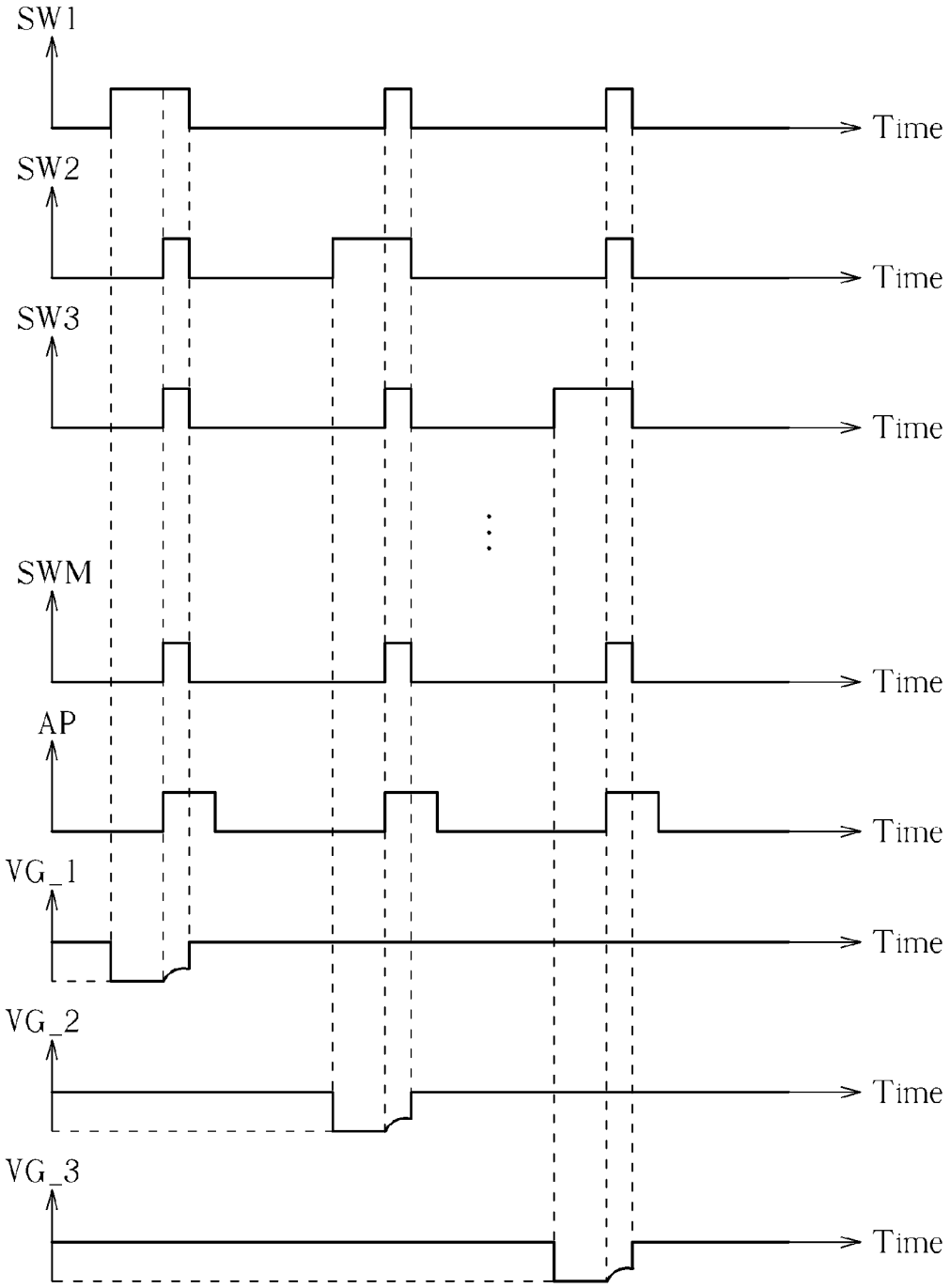
FIG. 8 is a timing diagram of buffer input signals, modulation signal and gate driving signals of the gate driver shown in FIG. 7, according to an embodiment.

Furthermore, please also note that, the gate driver 40 in FIGS. 4 to 6 assumes that the LCD display employs N-type FETs in pixel cells. That is, the N-type TFTs are enabled when the gate driving signals VG_1-VG_M are at the first voltage V1 to update pixel contents. Therefore, a level of the first voltage V1 of the first voltage source VS1 controlled by the switch module 420 is configured to be higher than that of the second voltage V2 of the second voltage source VS2. In other words, the switch module 420 is coupled to a high voltage side of the buffers 412_1-412_M. Alternatively, in other embodiments, an LCD display may employ P-type TFTs in pixel cells. In such a case, please refer to FIG. 7, which is a schematic diagram of an alternative embodiment of the gate driver 40 (labeled as a gate driver 70). The gate driver 70 is utilized for scanning the P-type TFTs of the LCD display. In the gate driver 70, the switch module 420 is replaced by a switch module 720, which includes a switch 722. The switch 722 breaks a power supply path of the first voltage source VS1 according to the modulation signal AP. FIG. 7 and FIG. 4 differ mainly in that the level of the first voltage V1 of FIG. 7 is configured to be lower than that of the second voltage V2, i.e. the switch module 420 is coupled to a low-voltage side of the buffers 412_1-412_M. Please continue to refer to FIG. 8, which is a timing diagram of the modulation signal AP, the buffer input signals SW_1-SW_M and the gate driving signals VG_1-VG_M of gate driver 70. FIGS. 8 and 6 are similar, merely differing in opposite polarities of the gate driving signals VG_1-VG_M. Related description can be analogized from the above, and is not narrated herein.

In the prior art, voltage variations of the gate driving signals VG_1-VG_M are coupled to equivalent capacitor 114 via parasitic capacitance, resulting in distorted image content stored in the equivalent capacitor 114. Therefore, it is desired to alleviate the coupling effect via modulating the waveforms of the gate driving signals. The above-mentioned embodiments adjust waveforms of the gate driving signals VG_1-VG_M through cutting off the power supply sent to the buffers at the falling edges of the gate driving signals VG_1-VG_M, and shorting the load capacitors C1-CM to invoke charge sharing of the stored charges. As a result, problems occurring in the prior art such as coupling effect and image distortion are alleviated. Furthermore, it is possible to decide the modulation amplitude through varying a quantity of charge sharing load capacitors, to meet different application requirements.

To sum up, the above-mentioned embodiments moderate the falling edges of the gate driving signals through charge sharing without employing extra complex control circuits, thereby achieving an economic and power-efficient solution to modulate the gate driving signals.

Those skilled in the art will readily observe that numerous modifications and alterations of the device and method may be made while retaining the teachings of the invention.

What is claimed is:

1. A gate driver; comprising:

a logic circuit, for generating a plurality of buffer input signals and a modulation signal;

a plurality of buffers, each receiving one of the plurality of buffer input signals and generating a gate driving signal according to the one of the plurality of buffer input signals, wherein the buffers are commonly coupled between a first voltage source node and a second voltage source; and a switch module, coupled to all of the buffers via the first voltage source node and coupled to a first voltage source, for determining whether the first voltage source is electrically connected to the first voltage source node according to the modulation signal;

wherein during a modulation period, the modulation signal causes the switch module to be cut-off and causes the first voltage source node to be connected to only the plurality of buffers and the plurality of buffer input signals are configured to short all or some of a plurality of output terminals, so as to modulate at least one of the gate driving signals;

wherein during the modulation period, the plurality of buffer input signals are at a first input level, and when each of the plurality of buffers receives the buffer input signal at the first input level, the output terminal of the buffer is connected to the first voltage source node and cut-off from the second voltage source.

2. The gate driver of claim 1, wherein the first voltage source node is cut-off from external circuits without receiving any additional voltage bias from 30 external power sources.

3. The gate driver of claim 1, wherein the modulation period is arranged at end portions of square waves of one or more of the plurality of gate driving signals.

4. The gate driver of claim 1, wherein during the modulation period, some or all of the plurality of output terminals of the plurality of buffers and the first voltage source node are mutually shorted.

5. The gate driver of claim 1, wherein during the modulation period, each voltage waveform of one or more of the plurality of gate driving signals has a rounded concave corner.

6. The gate driver of claim 1, wherein during the modulation period, charges stored in a plurality of loads coupled to some or all of the plurality of output terminals of the plurality of buffers are shared among the plurality of loads.

7. The gate driver of claim 1, wherein during the modulation period, one or more first gate driving signals of the plurality of gate driving signals are varied from a first driving level to a second driving level, and one or more second gate driving signals of the plurality of gate driving signals are varied from the second driving level to the first driving level.

8. The gate driver of claim 7, wherein during a driving period before the modulation period, the modulation signal enables the switch module, and the plurality of buffer input signals are configured to cause the one or more first gate driving signals to be at the first driving level, and the one or more second gate driving signals to be at the second driving level.

9. The gate driver of claim 8, wherein during a transition period after the modulation period, the modulation signal disables the switch module, and the plurality of buffer input signals are configured to cause the plurality of gate driving signals to be at the second driving level.

10. The gate driver of claim 9, wherein during a preparation period after the transition period, the modulation signal enables the switch module, and the plurality of buffer input signals are configured to cause the plurality of gate driving signals to be at the second driving level.

11. The gate driver of claim 1, wherein during a driving period before the modulation period, one or more buffer input signals corresponding to one or more first gate driving signals of the plurality of gate driving signals are at the first input level, and one or more buffer input signals corresponding to one or more second gate driving signals of the plurality of gate driving signals are at a second input level different from the first input level.

12. The gate driver of claim 1, wherein during a transition period after the modulation period, all of the plurality of buffer input signals are at a second input level different from the first input level.

13. The gate driver of claim 11, wherein when each of the plurality of buffers receives the buffer input signals with the second input level, the output terminal of the buffer is cut-off from the first voltage source node and is connected to the second voltage source.

14. The gate driver of claim 12, wherein when each of the plurality of buffers receives the buffer input signals with the second input level, the output terminal of the buffer is cut-off from the first voltage source node and is connected to the second voltage source.

15. The gate driver of claim 13, wherein during a preparation period after the transition period, all or the plurality of buffer input signals are at the second input level.

16. The gate driver of claim 14, wherein during a preparation period after the transition period, all of the plurality of buffer input signals are at the second input level.

17. The gate driver of claim 1, wherein each of the plurality of buffers comprises a voltage pull-up block and a voltage pull-down block connected in serial between the first voltage source node and the second voltage source, and each buffer utilized for outputting a first driving level and a second driving level, respectively, according to one of the plurality of the buffer input signals.

18. The gate driver of claim 17, wherein the voltage pull-up block and the voltage pull-down block of each of the plurality of buffers comprise a first type field effect transistor (FET) and a second type PET, respectively, and gate terminals of the two types of field effect transistors are coupled together as the buffer input terminal of the buffer.

19. A display device, comprising the gate driver of claim 1, and a panel, for displaying an image according to the control or the gate driver.

20. The gate driver of claim 1, wherein a terminal of the switch 30 module is coupled to the first voltage source node, and another terminal of the switch module is directly connected to the first voltage source.

21. The gate driver of claim 1, wherein the switch module is connected between the first voltage source and the first voltage source node, and each of the plurality of buffers is connected between the first voltage source node and the corresponding one of the plurality of output terminals respectively.

22. The gate driver of claim 1, wherein the first voltage source, the switch module, the first voltage source node, one of the plurality of buffers; and corresponding one of the plurality of output terminals are connected in sequence.

23. The gate driver of claim 1, wherein the switch module determines whether the first voltage source is electrically connected to the first voltage source node according to the modulation signal alone.

* * * * *